US005564200A

United States Patent [19]

Strahm

[11] Patent Number: 5,564,200

[45] Date of Patent: Oct. 15, 1996

[54] DEVICE FOR HEAT TREATMENT OF A CONTINUOUSLY GUIDED MATERIAL WEB, IN PARTICULAR A TEXTILE WEB

[75] Inventor: Christian Strahm, Bronschhofen, Switzerland

[73] Assignee: Solipat AG, Zug, Switzerland

[21] Appl. No.: 320,213

[22] Filed: Oct. 11, 1994

[30] Foreign Application Priority Data

Oct. 15, 1993 [CH] Switzerland ..... 3122/93
Oct. 27, 1993 [CH] Switzerland ..... 3231/93

[51] Int. Cl.[6] ..... F26B 9/00

[52] U.S. Cl. ..... 34/636; 34/635; 34/638; 34/643

[58] Field of Search ..... 34/629, 633, 636, 34/638, 639, 640, 643, 649, 654, 655, 647, 635, 656

[56] References Cited

U.S. PATENT DOCUMENTS 3,538,619 11/1970 Kleiner ..... 34/647
3,568,331 3/1971 Loveday ..... 34/635
4,638,572 1/1987 Fleissner ..... 34/639
4,817,299 4/1989 Pabst ..... 34/636
5,203,094 4/1993 Freiberg et al. .
5,303,484 4/1994 Hagen et al. ..... 34/640

FOREIGN PATENT DOCUMENTS

0471162A1 6/1991 European Pat. Off. .
2143774 9/1971 Germany .
255201 12/1986 Germany .

*Primary Examiner*—James C. Yeung
*Attorney, Agent, or Firm*—Shoemaker and Mattare, Ltd.

[57] ABSTRACT

The material web (1) is acted upon by heated circulating air which permeates with the aid of a fan (7) from a pressure chamber (14) via inlets (6, 6') into the nozzle casings (4, 4'). In order to achieve laminar flow and thus an improved distribution of air, the fan (7) is removed as far as possible from the inlets (6, 6') and preferably suspended beneath the cover-wall (16) of the housing (2). This results in a relatively large and longitudinally extended pressure chamber (14) between the inlets (6, 6') and the pressure side (12) of the fan (7).

17 Claims, 4 Drawing Sheets

DEVICE FOR HEAT TREATMENT OF A CONTINUOUSLY GUIDED MATERIAL WEB, IN PARTICULAR A TEXTILE WEB

BACKGROUND OF THE INVENTION

The invention concerns a device for the heat treatment of a continuously guided material web, in particular a textile web, such devices, also called nozzle driers and convection dryers, have been known and in use for a long time in the textile industry for the treatment of woven and knitted fabrics. It is usual that heated, ambient air is used as a treatment medium, and that in certain cases other gaseous mediums or mixtures are employed.

A related and comparable device is, for example, made known in German Auslegenschrift DD-A-255 201. A problem with known devices is that a turbulent flow exists in the housing, and in particular also in the nozzle casings, which leads to irregular temperature distribution and thus an unsatisfactory drying result. Apart from that, the individual nozzle casings are only accessible from the outside with difficulty, and heat efficiency of the system as a whole is relatively poor, in spite of the use of insulating material.

SUMMARY OF THE INVENTION

It is therefore a purpose of the invention to create a device of the type mentioned in the introduction with which the thermal efficiency is generally optimized and with which uniform distribution of the treatment medium is achieved as free from turbulence as possible and also, in particular, with uniform distribution of temperature on the material web. Finally, the device shall also provide improved accessibility for service and repair work. According to the invention, this purpose is fulfilled with a device as described below. Surprisingly, it has in this respect been demonstrated that the fan must not be arranged as near as possible to the nozzle casing inlet openings, as is the case with known devices, but that in contrast considerably better results can be achieved if the distance between the fan and the air inlet is selected to be as large as possible. By means of the large and relatively long pressure chamber, a laminar airflow can form, leading to regular distribution of air to all nozzles over the entire width of the drying chamber. Temperature distribution will also be considerably better than with the unavoidably turbulent flows in the relatively short drying chambers of prior devices.

If the housing possesses a cover-wall, and if the fan is arranged beneath the cover-wall, the area of the material web will remain freely accessible, also on the fan side. The axis of rotation of the fan can run vertically and the drive device can be arranged above the cover-wall, on the housing. In this way, the drive device is accommodated in a space-saving way, and will be optimally accessible.

Further advantages will be achieved if the heating device is arranged in the pressure chamber between the fan and the inlet opening on the nozzle casings. As a result of the expansion of the treatment medium within the pressure chamber, the exhaust speed will increase at the nozzle outlets without the need for an increase in fan performance. In addition, heat losses will be reduced to a minimum. Heating devices can be a radiator unit which is able to be connected to a heat source or a gas-burner arranged on the cover-wall, positioned in the direction of flow. In the latter case, control components allocated to the gas-burner and means of supply can also be accommodated on the housing cover.

A particularly optimal action on the material web will result if at least an upper and a lower nozzle casing is arranged on both its sides, and if the volume of treatment medium fed to both the nozzle casings is able to be controlled by an articulated flap mounted between the upper and the lower inlet openings. By means of this flap, the uniform flow from the fan can easily be distributed according to volume, without in turn causing damaging turbulence.

For switching-off the treatment procedure, for example when the material web is at a standstill, the upper and lower inlet opening are able to be closed-off with equidirectional pivoting bypass flaps, a bypass opening being arranged between the pressure and return-flow chamber and the bypass opening being able to be closed-off by means of the lower bypass flap.

The accessibility of the device will be further improved if the housing on both longitudinal sides is provided with a sliding or pivoting door.

An additional optimisation of heat efficiency is achieved if the device is provided with an exhaust duct for removal of the treatment medium from the housing extending in a known way parallel to the transport direction and if this exhaust duct is designed as a heat exchanger. This can be achieved by running through the exhaust duct a plurality of tubes for the supply of fresh air into the housing, the fresh air thus being preheatable. The exhaust duct is, arranged with particular advantage in the return-flow chamber at the base of the housing, the tubes extending transverse to the exhaust duct. In this way, direct fresh air is introduced from outside through the housing wall into the return-flow chamber, and will be drawn into the fan from there. Thus, optimal recovery of heat will be achieved if in each case goups of numerous tubes are arranged above one another in a plane which is inclined in relation to the direction of transport.

Further improvements to the flow conditions can be achieved through special design of the fan. This is indeed formed in a known way as a radial ventilator with a rotor and with a ventilator housing, on which a radial exhaust outlet is arranged, extending in an approximately spiral shape around the rotor axis. As opposed to conventional radial ventilators installed in these kinds of devices, however, the length of the exhaust outlet extending at a right angle to the rotor axis is larger than the maximum radius of the ventilator housing. The exhaust outlet is in addition also arranged on the end of an exhaust adaptor, in which guide vanes are arranged approximately parallel to the rotor axis for uniform distribution of the flow throughout the whole cross section of the exhaust outlet. Optimal flow conditions are already obtained directly at the inlet to the pressure chamber by this means.

Further advantages can be achieved if the width of the exhaust outlet extending parallel to the axis of the rotor is reduced in relation to the width of the housing in the area of the rotor. By this measure, complete filling of the exhaust outlet by the flow only at the outer edge of the spiral will be avoided. The width reduction in relation to the width of the spiral housing causes uniform flow density throughout the entire outlet cross section.

The reduced width of the exhaust outlet can be approximately the same over the entire length of the exhaust adaptor, in other words it can be the same width across the entire cross section at the inlet of the exhaust adaptor. It is also conceivable, however, to reduce the width at the inlet of the exhaust adaptor from the outside towards the inside either gradually or in steps.

The guide vanes can become thicker in the direction of flow and can be bluntly truncated in the area of the outlet.

Thus, the degree of flow retardation will be reduced. With a diffusor connected to the system, retardation across the entire width of the spiral housing could be further increased.

Advantageous lengths and width ratios at the exhaust outlet can be attained if the spiral curve of the housing wall extends through an angle of less than 270°, preferably between 220° and 240°. At the same time, the length of the exhaust outlet can actually be larger than the maximum diameter of the housing.

BRIEF DESCRIPTION OF THE DRAWINGS

In the accompanying drawings

DESCRIPTION OF THE EMBODIMENTS

Figure 1:
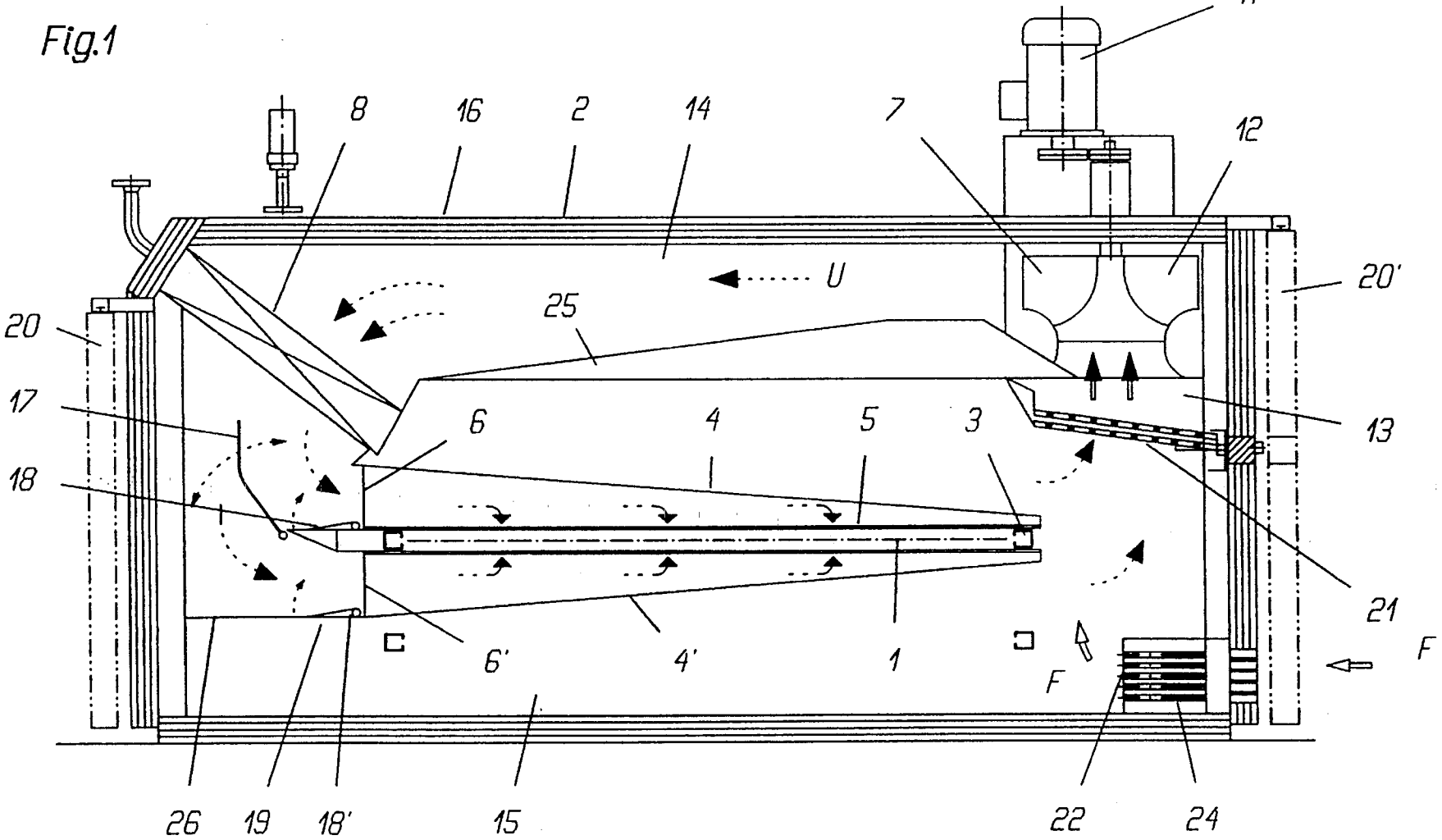
FIG. 1 A cross section through a drier with radiator heating during drying operation, FIG. 2 a cross section through a drier with gas heating, in bypass operation with closed nozzle casings, FIG. 3 a side view of an entire drying line comprising numerous individual devices at a highly reduced scale, FIG. 4 a perspective portrayal of a radial ventilator, FIG. 5 a plan view of a further embodiment of a radial ventilator, and FIG. 6 a side view of the radial ventilator according to FIG. 5.

The device shown in FIG. 1 comprises a housing 2 which in cross section is approximately rectangular and preferably provided with a heat insulating layer. A material web 1 is guided through the housing by means of a suitable guidance or conveying means, for example a stentering frame. Numerous nozzle casings 4, 4' are arranged in the direction of transport on both sides of the material web 1, in each case a gap remaining between the individual nozzles for passage of the exhaust air. The nozzle casings are provided with nozzle outlets 5 directed towards the material web 1. Entry of the circulating air U into the nozzle casings is achieved via the inlets 6, 6', the cross section of the nozzle casings being tapered in line with the air volume required.

A fan 7 is mounted beneath the cover-wall 16, on the side of the housing opposite to the inlets 6, 6'. The drive device 11 for the fan is arranged above the cover-wall 16, if necessary a suitable transmission being placed within the drive train. With the aid of a partition 25, a pressure chamber 14 is defined between the inlets 6, 6' and the pressure side 12 of the fan, the remaining space forming a return-flow chamber 15 which on the one hand surrounds the individual nozzle casings 4, 4' and on the other hand is connected to the suction side 13 of the fan 7.

Both the inlets 6 and 6' are able to be closed off with equidirectional pivotable bypass flaps 18, 18'. In the embodiment according to FIG. 1, both these bypass flaps are in the fully opened position so that the nozzle casings 4, 4' receive the maximum air volume. A lower partition 26 is arranged beneath the lower inlet 6', in which the bypass aperture 19 is provided. This bypass aperture lies within the pivoting area of the lower bypass flap 18' so that it is able to be closed off by said lower flap. In this way, the circulating air U can only enter the return-flow chamber 15 after impinging on the material web 1.

Between the upper and the lower inlets 6, respectively 6', a flap 17 is mounted to articulate, with the aid of which the air volume fed to the individual nozzle casings 4, 4' can be controlled. In the respective extreme position, either of the two nozzle casings can be completely disconnected from the circulating air.

A radiator arrangement extends, inclined, above the upper inlet 6 from the left upper corner of the housing 2, said radiator arrangement being able to be connected to a heat source which is not shown here. This can be heated steam or heated oil.

Beneath the fan 7, on the suction side 13, a sieve 21 is arranged in which fluff and other contamination can be retained and which can be changed from the outside during operation.

An exhaust duct 22 is arranged in the return-flow chamber 15 at the base of the housing 2, said duct extending parallel to the direction of transport through the housing. This duct is penetrated by transverse tubes which pass through the housing wall, and are open to the outside and to the return-flow chamber 15 As can be particularly seen from FIG. 3, the duct 22 can extend along a whole line of numerous interconnected devices. A portion of the circulating air U is drawn into an extractor fan 23 as exhaust air A and must accordingly be replaced by fresh air F. The cold fresh air F enters through the tubes 24 and at the same time is heated in the hot exhaust air A. This heat recovery results in a considerable improvement in heating performance. An optimal effect can be achieved if the individual tubes 24 are arranged on a plane with an inclined formation one above the other in the exhaust duct 22. According to FIG. 3, the tubes 24 are only arranged in the drying section 27, whilst the treatment section 28 of the exhaust duct 22 is closed off.

Doors 20, 20' are arranged on both the longitudinal sides of the housing 2, in such a way that they can be slid or pivoted into the open position. Thus, the inner space of the dryer is easily accessible from both sides.

Figure 2:
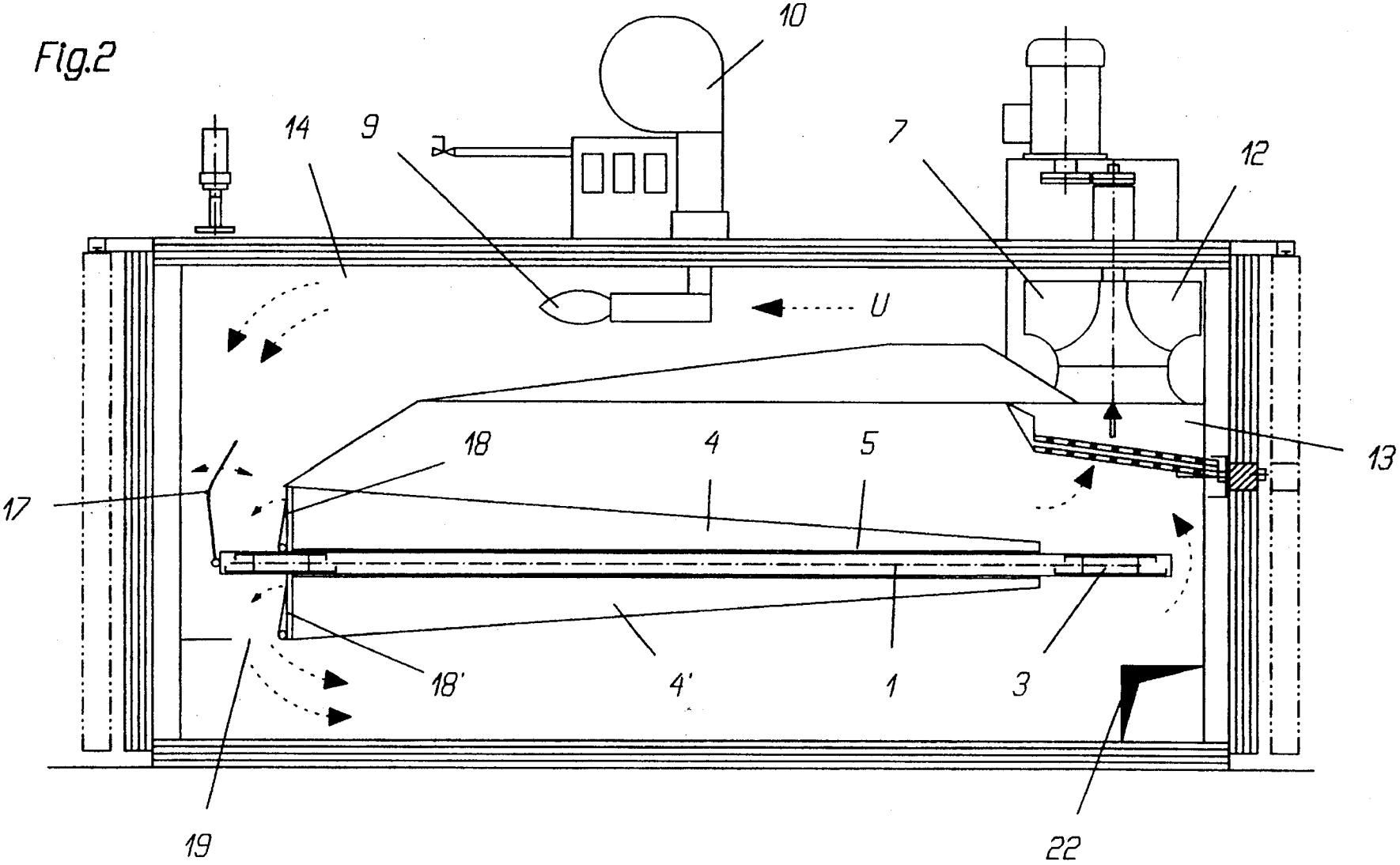

With respect to the arrangement of nozzle casings 4, 4' and the fan 7, the device in the embodiment according to FIG. 2 is shown with a similar construction to FIG. 1. In place of a radiator arrangement, however, a gas-burner is arranged on the cover-wall 16. The burner-fan 10 and if necessary further control components of which are affixed to the cover-wall 16. In addition, the exhaust duct 22 is here not penetrated by tubes 24, but is closed off.

In contrast to the preceding embodiment, both the bypass flaps 18 and 18' are fully closed, the bypass aperture 19 being fully revealed. In this operating mode, the circulating air U only circulates between the pressure chamber 14 and the return-flow chamber 15 without, however, at the same time acting upon the material web 1. This type of operating mode is required, for example when the material web 1 is at a standstill, in order to avoid damage through increased heat effect.

Figure 3:
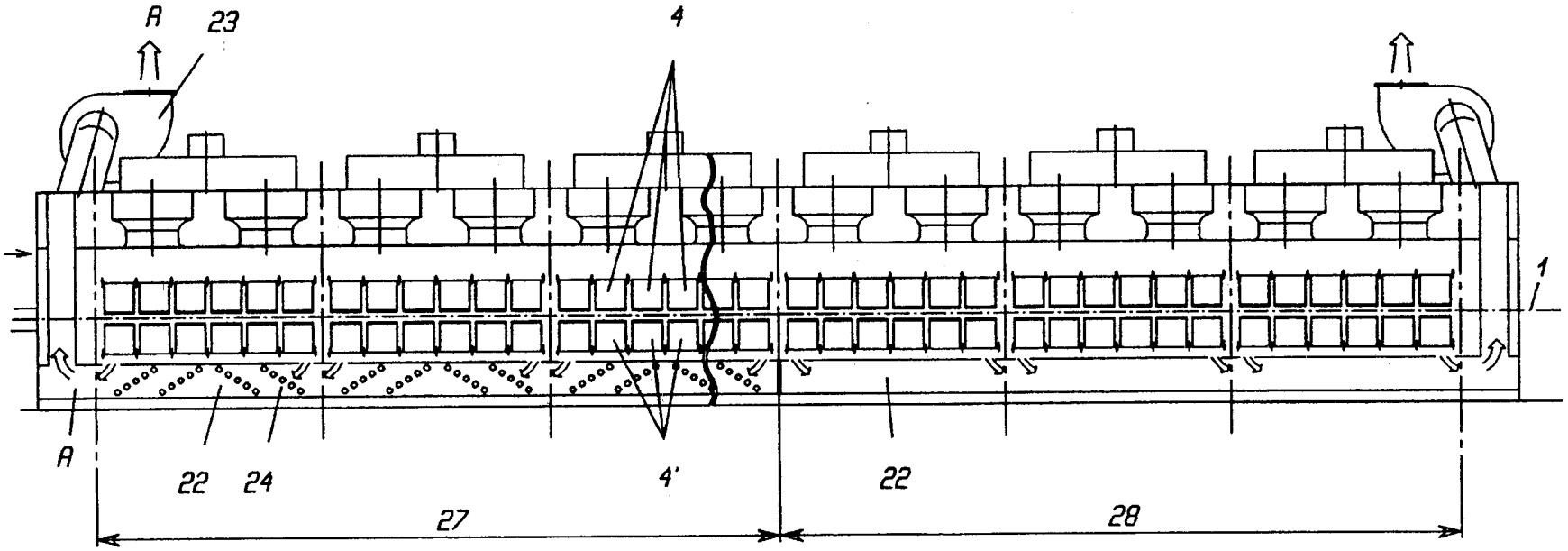

The line according to FIG. 3 comprises individual units each with six nozzle casings 4, 4' on each side of the textile web 1. Each unit has two fans 7. Naturally, other combinations can be chosen without departing from the framework of the invention's subject matter.

Figure 4:
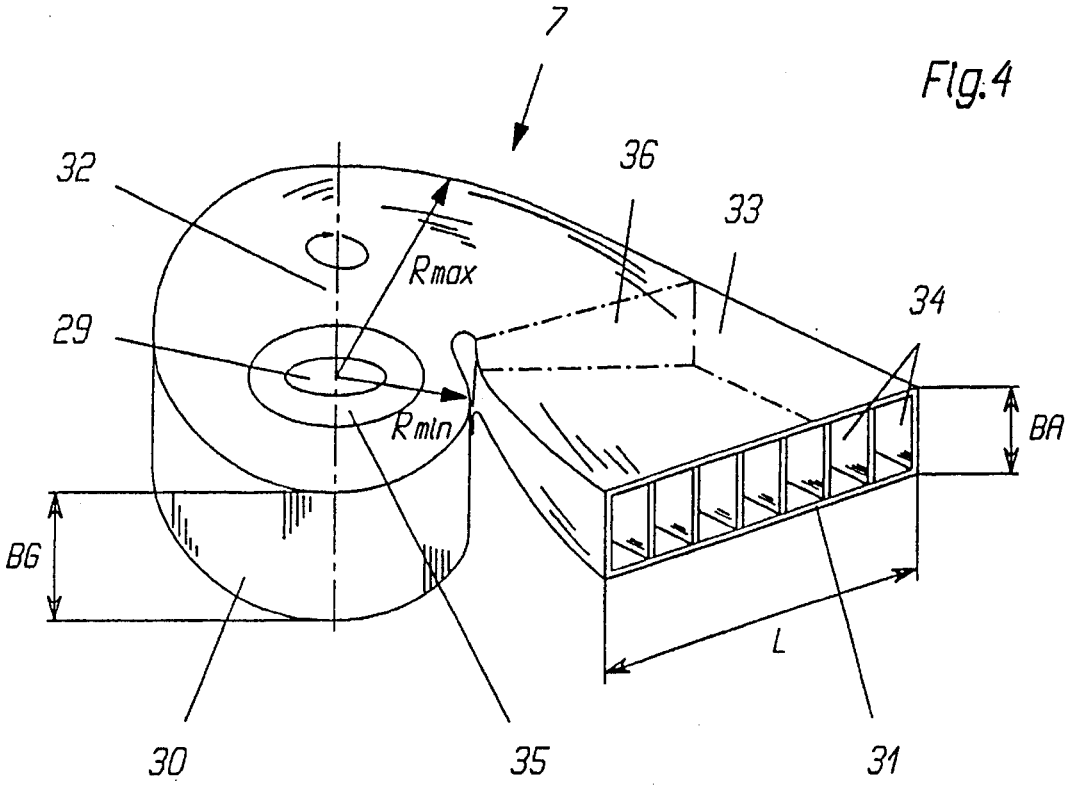

FIG. 4 shows, somewhat simplified, a radial ventilator 7 comprising an approximately spiral shaped ventilator housing 30 in which a rotor 29 is arranged. With that, the rotor rotates around an axis 32, with air being drawn into the suction inlet 35. At the end of the spiral, thus approximately at the maximum diameter Rmax, an exhaust adaptor 33 is attached to the ventilator 30. This exhaust adaptor opens into an exhaust outlet 31, the length L of which is greater than the maximum radius Rmax. Guide vanes 34 are arranged in the exhaust adaptor 33, said guide vanes distributing the flow uniformly. The width BA at the exhaust outlet 31 is less than the width BG of the spiral housing. This width is already reduced at the inlet cross section 36 of the exhaust adaptor, the width of the greater radius Rmax being able to be further reduced to the lesser radius Rmin at this point.

Figure 5:
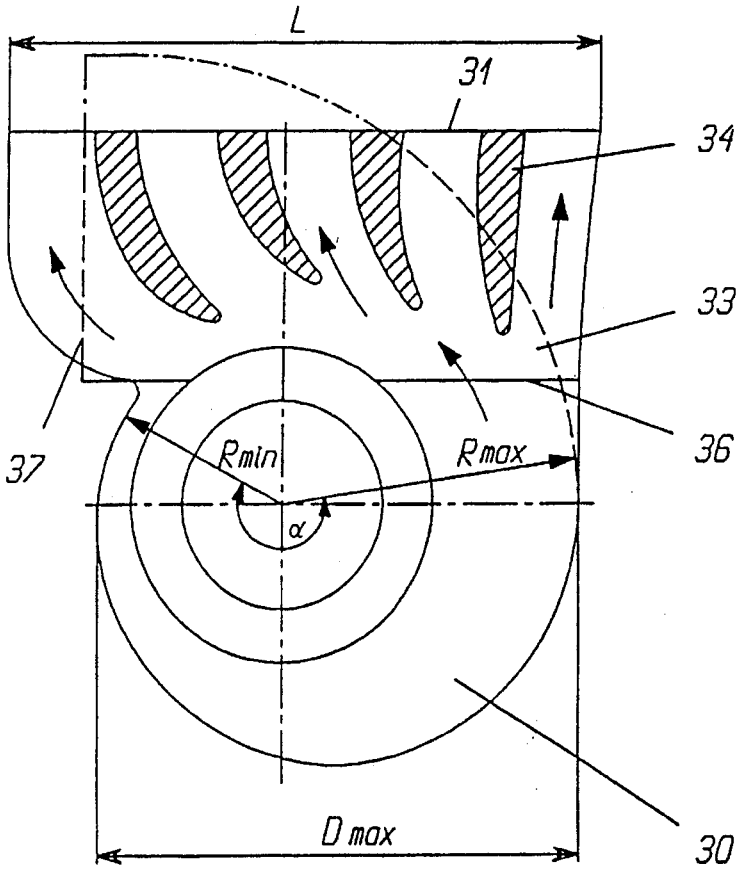
Figure 6:
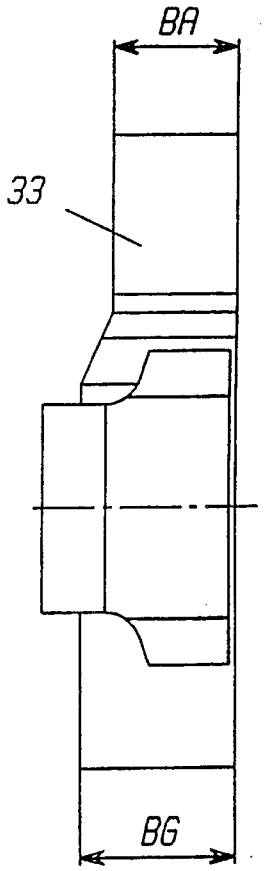

The geometry of another radial ventilator is somewhat more exactly illustrated in FIGS. 5 and 6. The spiral shaped housing 30 extends from a minimum radius Rmin to a maximum radius Rmax only through an angle α of approximately 220° to 240°. At the greatest radius Rmax, the exhaust adaptor 33 runs almost at a tangent to the outer wall of the housing 30. As opposed to that, the exhaust adaptor at the lesser radius Rmin extends with a curve up to the length L of the outlet 31. The guide vanes 34 are adjusted to the shape of this curve.

It can be seen from FIG. 6 that the exhaust adaptor 33 possesses a reduced width BA compared with the width BG on the spiral housing, this being a gradual reduction to the outlet 31.

The length L of the outlet 31 is greater than the maximum diameter Dmax at the spiral housing 30. A standard 360° spiral is depicted by the dotted line 37. From this, it can be seen that the truncation of the spiral in practice leads to an exhaust adaptor which is turned through 90°.

As an additional special feature, the guide vanes 34 in this embodiment are formed to thicken in cross section towards the outlet 31. In the plane of the outlet, the guide vanes are bluntly truncated. The end sections of the guide vanes all run in the plane of the outlet approximately parallel and at a right angles to the outlet. The guide vane nearest to the lesser radius Rmin is relatively heavily curved, whilst the guide vane nearest to the greater radius Rmax runs with a stretched-out form.

Inasmuch as the invention is subject to modifications and variations, the foregoing description and accompanying drawings should not be regarded as limiting the invention, which is defined by the following claims and various combinations thereof:

I claim:

1. A device for heat treating a continuous material web with a gaseous medium, said device comprising a housing, means within the housing for guiding said web material through the housing along a predetermined path, a nozzle casing arranged parallel to said path, and containing a plurality of nozzles directed toward said path, said nozzle casing having an inlet at one end of the housing, a fan for generating a recirculating flow within the housing, the fan being situated within the housing at an end of the housing opposite the casing inlet, a heater, situated downstream of the fan, between the fan and the nozzle casing inlet, for heating the treatment medium, and means within the housing defining a pressure chamber extending between the nozzle casing inlet and the outlet of said fan.

2. A device as recited in claim 1, wherein the housing has a removable cover, and the fan is arranged beneath the cover.

3. A device as recited in claim 2, further comprising means for driving the fan, said drive means being arranged above the cover, on the housing.

4. A device as recited in claim 1, wherein the heater is a radiator which can be connected to a heat source, said radiator being situated in the pressure chamber above the casing inlet.

5. A device as recited in claim 1, wherein the heater is a gas burner arranged within the pressure chamber, in the direction of flow of the medium.

6. A device as recited in claim 1, further comprising a second nozzle casing arranged parallel to said path, on the opposite side of the path from said first nozzle casing, and containing a second plurality of nozzles directed toward said path.

7. A device as recited in claim 6, further comprising an articulated flap for dividing flow from the fan and heater between the two casings.

8. A device as recited in claim 6, further comprising a pair of bypass flaps for closing off the inlets to the respective nozzle casings, and an aperture in the pressure chamber defining means for permitting said medium to bypass said nozzle casings, the lower of said bypass flaps being arranged to close said aperture in one position thereof.

9. A device as recited in claim 1, wherein the housing further comprises a pair of doors, at either longitudinal end thereof.

10. A device as recited in claim 1, further comprising at least one exhaust duct extending parallel to said path, for exhausting said medium from the housing, and an array of heating tubes for preheating air entering the housing.

11. A device as recited in claim 10, wherein the exhaust duct is arranged at the base of the housing within the return flow chamber, and the tubes run transversely to the exhaust duct.

12. A device as recited in claim 10, further comprising plural groups each comprising a plurality of tubes arranged one above the other in a plane oblique to said path.

13. A device as recited in claim 1, wherein the fan is a radial ventilator with a rotor and an approximately spiral shaped ventilator housing extending around the rotor axis, a radial outlet being formed in said ventilator housing, the length of the outlet extending at a right angle to the rotor axis being greater than the maximum radius on the ventilator housing and the outlet being arranged at the end of an exhaust adaptor in which guide vanes, running approximately parallel to the axis of the rotor, are arranged throughout the entire cross section of the outlet, for uniformly distributing flow of the medium.

14. A device as recited in claim 13, wherein the width of the outlet is reduced in comparison to the housing width in the area of the rotor.

15. A device as recited in claim 13, wherein the width of the inlet of the exhaust adaptor decreases from the greater radius to the lesser radius of the spiral.

16. A device as recited in claim 13, wherein the guide vanes thicken in the direction of flow and are truncated bluntly in the area of the outlet.

17. A device as recited in claim 13, wherein the guide vanes run approximately at a right angle to the plane of the outlet.

* * * * *